US007176842B2

(12) United States Patent
Bettner et al.

(10) Patent No.: US 7,176,842 B2
(45) Date of Patent: Feb. 13, 2007

(54) DUAL BAND SLOT ANTENNA

(75) Inventors: Allen W. Bettner, Los Gatos, CA (US); Xintian E. Lin, Mountain View, CA (US); Alan E. Waltho, San Jose, CA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 10/976,981

(22) Filed: Oct. 27, 2004

(65) Prior Publication Data

US 2006/0097941 A1 May 11, 2006

(51) Int. Cl.
*H01Q 13/10* (2006.01)

(52) U.S. Cl. ..... 343/767; 343/702

(58) Field of Classification Search ..... 343/767, 343/770, 702

See application file for complete search history.

(56) References Cited

U.S. PATENT DOCUMENTS

| | | | | |
|---|---|---|---|---|
| 6,285,333 | B1 * | 9/2001 | Reed et al. | 343/767 |
| 6,417,807 | B1 * | 7/2002 | Hsu et al. | 343/700 MS |
| 6,600,448 | B2 * | 7/2003 | Ikegaya et al. | 343/700 MS |
| 6,828,942 | B2 * | 12/2004 | Louzir et al. | 343/769 |
| 6,864,848 | B2 * | 3/2005 | Sievenpiper | 343/767 |
| 6,927,735 | B2 * | 8/2005 | Lindenmeier et al. | 343/712 |

* cited by examiner

*Primary Examiner*—Tan Ho
(74) *Attorney, Agent, or Firm*—Lanny L. Parker

(57) ABSTRACT

A slot antenna having one or more electronic components attached across a slot of the antenna to provide either an RF open or an RF short based on the bias supplied to a control terminal of the electronic component. The antenna is tunable via the RF open or short across the slot.

8 Claims, 6 Drawing Sheets

DUAL BAND SLOT ANTENNA

Conventional wireless data modems configured to operate with laptop Personal Computers ("PCs") are typically designed with fixed, embedded, flip-up antennas. Dual band conventional antenna systems are fabricated on separate substrates and signals fed through a diplexer. The desirable performance levels for efficiency and radiation pattern of these conventional antennas are necessarily compromised due to the proximity effect of the screen and keyboard that may affect the impedance and pattern of the antenna. Therefore, what is needed is a mobile antenna system that overcomes the problems found in the conventional antenna systems.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
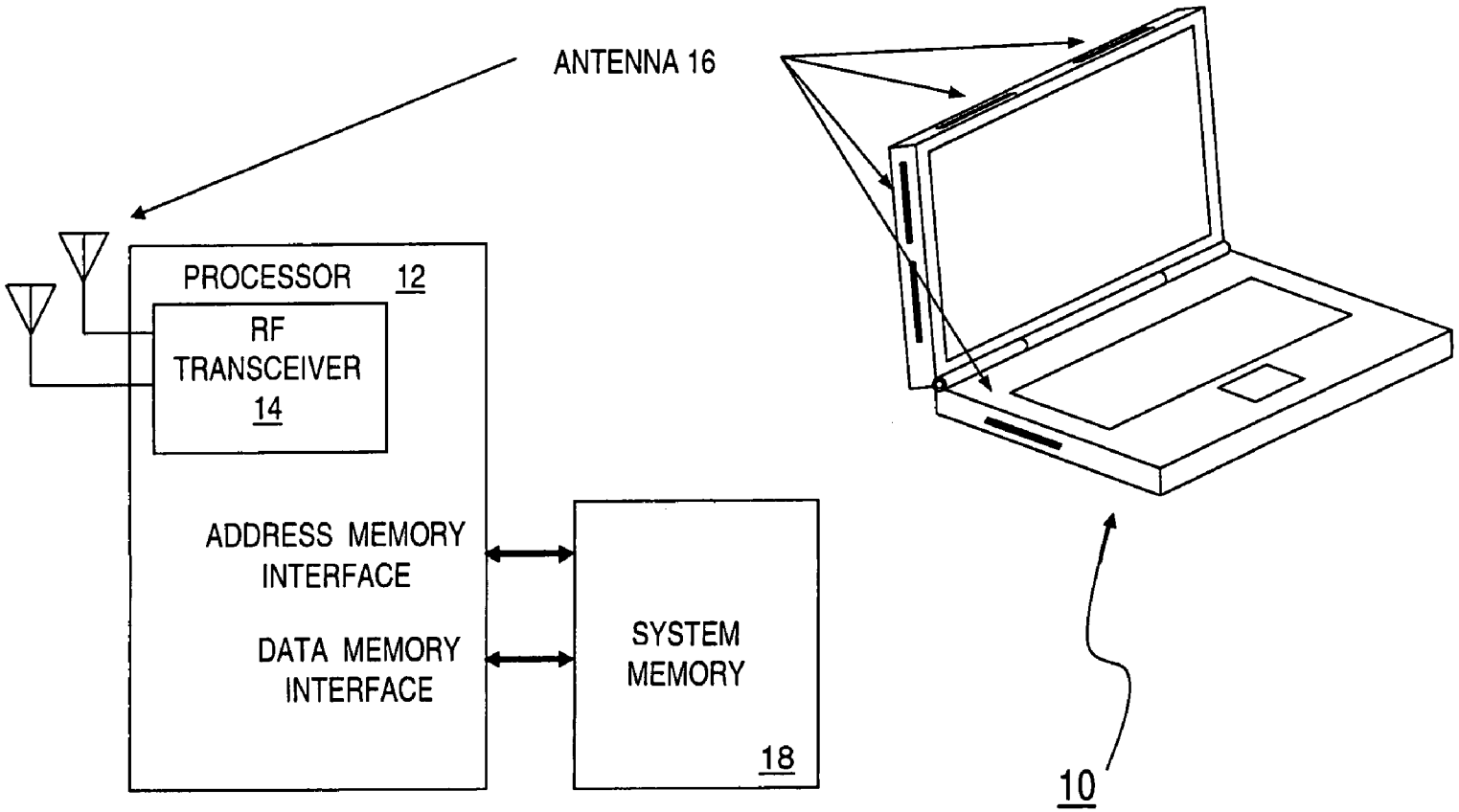
FIG. 1 illustrates a slot antenna having features of the present invention that may be incorporated into a wireless communications device.

It will be appreciated that for simplicity and clarity of illustration, elements illustrated in the figures have not necessarily been drawn to scale. For example, the dimensions of some of the elements may be exaggerated relative to other elements for clarity. Further, where considered appropriate, reference numerals have been repeated among the figures to indicate corresponding or analogous elements.

DETAILED DESCRIPTION

In the following detailed description, numerous specific details are set forth in order to provide a thorough understanding of the invention. However, it will be understood by those skilled in the art that the present invention may be practiced without these specific details. In other instances, well-known methods, procedures, components and circuits have not been described in detail so as not to obscure the present invention.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other while "coupled" may further mean that two or more elements are not in direct contact with each other, but yet still co-operate or interact with each other.

FIG. 1 illustrates features of the present invention that may be incorporated into a wireless communications device 10 such as, for example, a portable computer. Although the present invention is shown in a laptop computer, embodiments of the present invention may be used in a variety of applications. The present invention may be incorporated into smart phones, communicators and Personal Digital Assistants (PDAs), medical or biotech equipment, automotive safety and protective equipment, and automotive products. However, it should be understood that the scope of the present invention is not limited to these examples.

In the wireless communications embodiment, a transceiver 14 both receives and transmits a modulated signal from one or more antennas 16. The analog front end transceiver may be a stand-alone Radio Frequency (RF) integrated analog circuit, or alternatively, be embedded with a processor 12 as a mixed-mode integrated circuit. The received modulated signal may be frequency down-converted, filtered, then converted to a baseband, digital signal. Processor 12 may include baseband and applications processing functions, and in general, be capable of fetching instructions, generating decodes, finding operands, performing the appropriate actions and storing results.

The digital data processed by processor 12 may be stored internally in an embedded memory or transferred across an interface for storage by a system memory 18. System memory 18 may include a variety or combination of memories. As such, the storage devices may be volatile memories such as, for example, a Static Random Access Memory (SRAM), a Dynamic Random Access Memory (DRAM) or a Synchronous Dynamic Random Access Memory (SDRAM), although the scope of the claimed subject matter is not limited in this respect. The memory devices may also be nonvolatile memories.

The embodiment of wireless communications device 10 illustrated in the figure has slot antennas cut, or otherwise formed, potentially in any surface of a mobile device. Note that various configurations of slot antennas may be formed in the wireless device to provide advantages such as durability and a low profile compared to other prior art antenna configurations.

Figure 2:
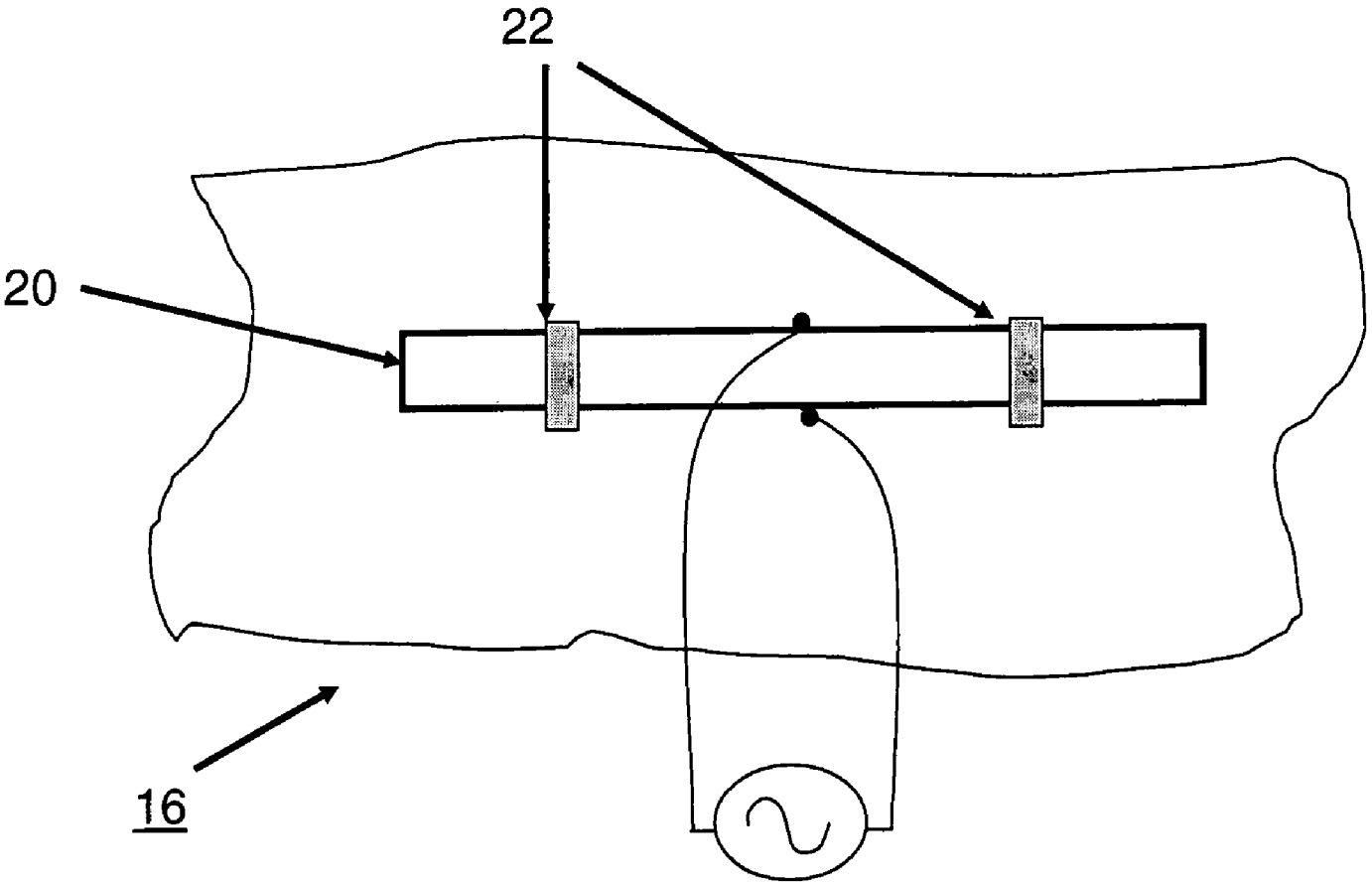
FIG. 2 illustrates the slot antenna having a shorting strap that may be located in one or more slot locations of the slot antenna.

FIG. 2 further illustrates a slot antenna 16 that may be used in one or more slot locations in wireless communications device 10. Slot antenna 16 includes a slot 20 or opening that may be formed in the conductive skin of device 10 which may be metal, or alternatively, a plastic with a conductive coating or mesh. The opening or slot in the conductive skin of the device forms an antenna, with the resonant frequency of slot 20 dependent upon the physical dimensions of that slot. In this embodiment slot 20 is about 2 mm in width, about 93 mm in length and cut into a skin having a thickness of about 3 mils, although other physical dimensions may be used without limiting the claimed invention.

In accordance with the present invention, slot antenna 16 includes one or more electronic components 22 judiciously placed across the opening of slot 20 or included as a segment of the conductive skin to cover a selected portion of slot 20. In one embodiment electronic component 22 may be a passive shorting bar or strap that is formed from the same material as the conductive skin of wireless communications device 10. Alternatively, electronic component 22 may be a passive shorting strap formed by a conductive metal such as, for example, a copper wire that is attached across the opening of slot 20. Slot 20 may be tuned to operate at a frequency of about 2.4 GHz, but the addition of the passive shorting straps shifts the resonance to a frequency of about 5.5 GHz, although these resonance frequencies are not intended to limit the present invention.

Figure 3:
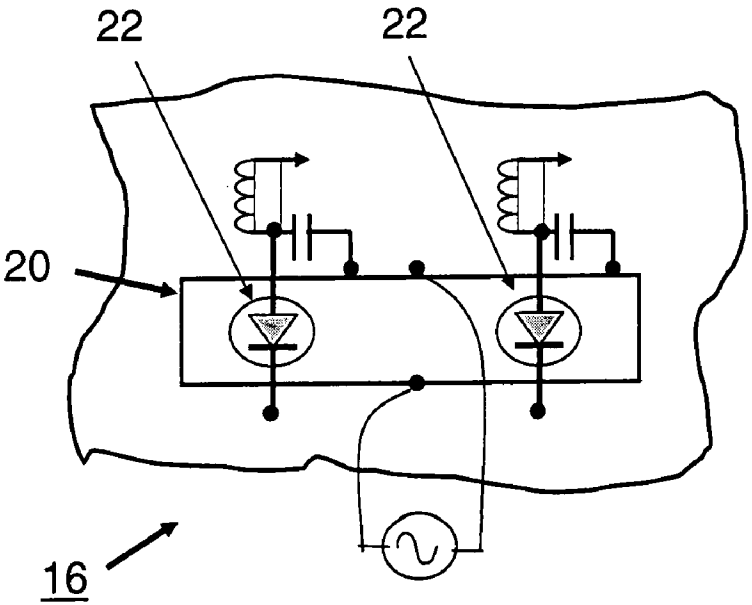
FIG. 3 illustrates PIN diodes located across the slot of the slot antenna that are biased using an inductor and capacitor.

In accordance with another embodiment and as shown in FIG. 3, electronic component 22 may be an active semiconductor component that includes P-N junctions. Electronic components 22 allow the modem in wireless communications device 10 to switch frequency bands electronically. Rather than altering the physical length of slot 20 to "tune" the antennas to a desired frequency, electronic component 22 may be used to effectively alter the tuned frequency without making any physical changes to the slot. In other words, a slot may be tuned to operate at a frequency of about 2.4 GHz, but the resonance (minimum return loss) may be shifted to a higher frequency by altering the conductivity of electronic components 22.

The PIN (Positive-Intrinsic-Negative) diode is a semiconductor device with a neutrally doped intrinsic region between P-doped and N-doped semi-conducting regions. In this embodiment, the PIN diodes operate as a variable resistor at RF and microwave frequencies. The resistance value of the PIN diode is determined by the forward biased DC current and when used in switch applications, the PIN diode ideally controls the RF signal level without introducing distortion which might change the shape of the RF signal. The figure illustrates a method of biasing the PIN diodes that uses a capacitor and an inductor. The inductor isolates the input signal from the RF and the capacitor couples the diode to the top side of slot 20 when the diode is conductive.

Figure 4:
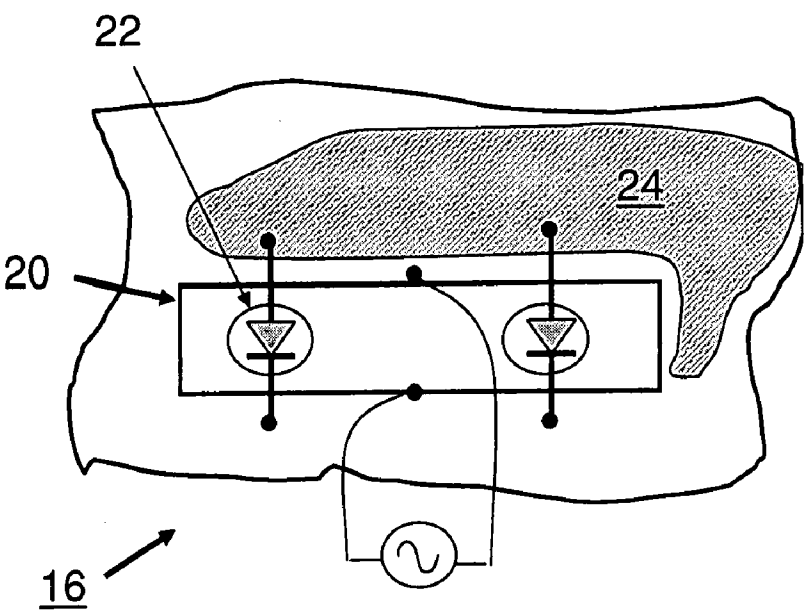
FIG. 4 illustrates PIN diodes located across the slot of the slot antenna that are biased utilizing an overlay layer on at least one side of the slot.

FIG. 4 illustrates an alternate embodiment that provides biasing to the PIN diodes without the use of any discrete components using an "overlay" layer 24 on one side of slot 20. In the alternate embodiment a Printed Circuit Board (PCB) overlay layer 24 isolates the anode terminal from the cathode terminal of the PIN diodes, such that the capacitance from the overlay layer couples the RF signals and both sides of the slot are at an RF ground potential. The resonance frequency of slot 20 may be switched from one frequency to another frequency by introducing a bias for the PIN diodes from any point on overlay layer 24. Thus, the conductivity of the PIN diodes may be controlled by providing a voltage potential directly to overlay layer 24 that causes slot antenna 16 to switch frequency bands.

Figure 5:
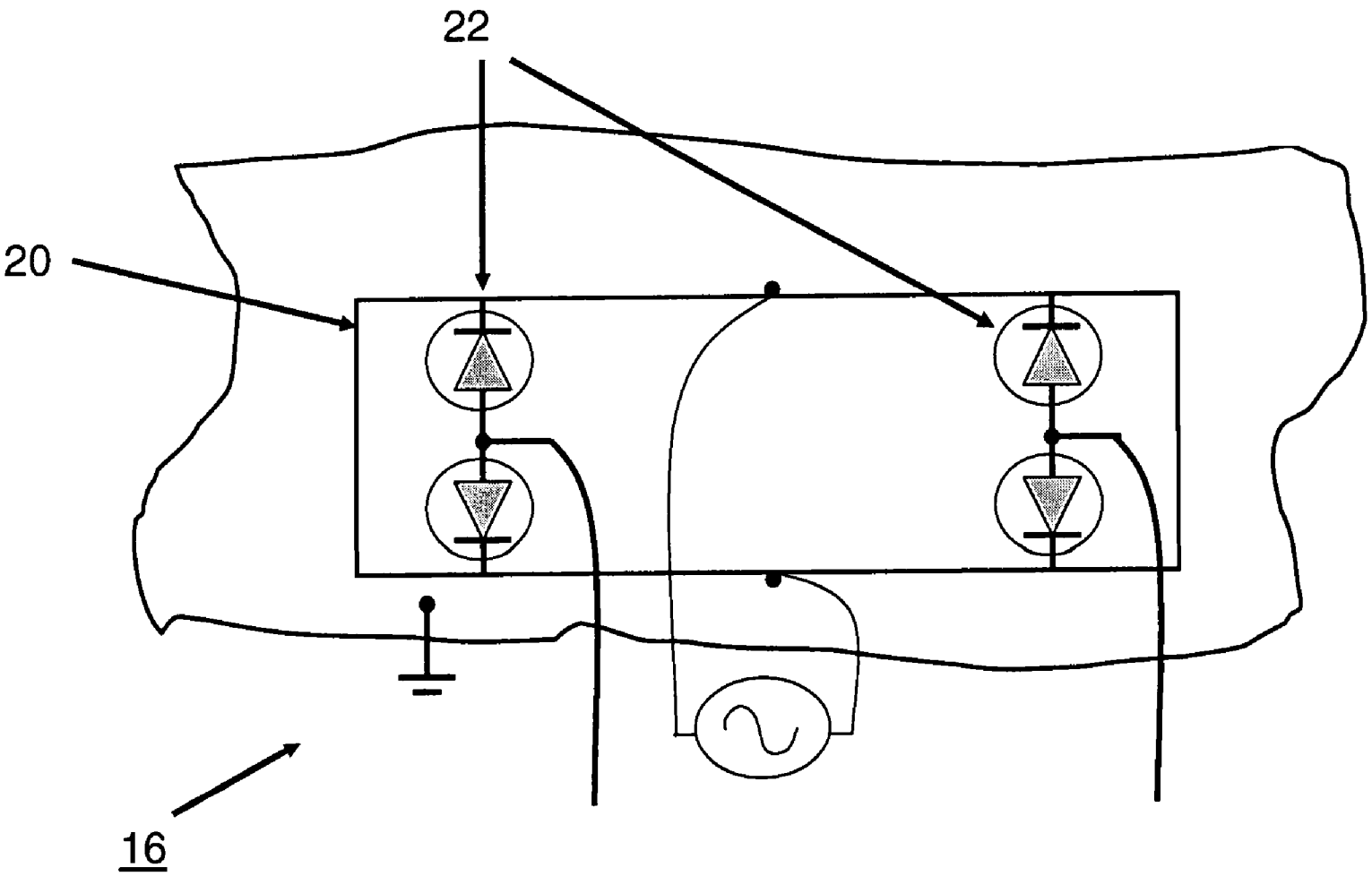
FIG. 5 illustrates biasing back-to-back PIN diodes positioned across the slot of the slot antenna.

FIG. 5 illustrates biasing back-to-back PIN diodes without using discrete components to provide biasing. In this figure electronic component 22 has back-to-back PIN diodes positioned across slot 20, where the diodes appear as an RF open when no bias is supplied and an RF short when a bias is supplied and the diodes are conductive. The bias may be supplied to the commonly connected anodes of the PIN diodes with the cathodes connected to a ground potential.

Figure 6:
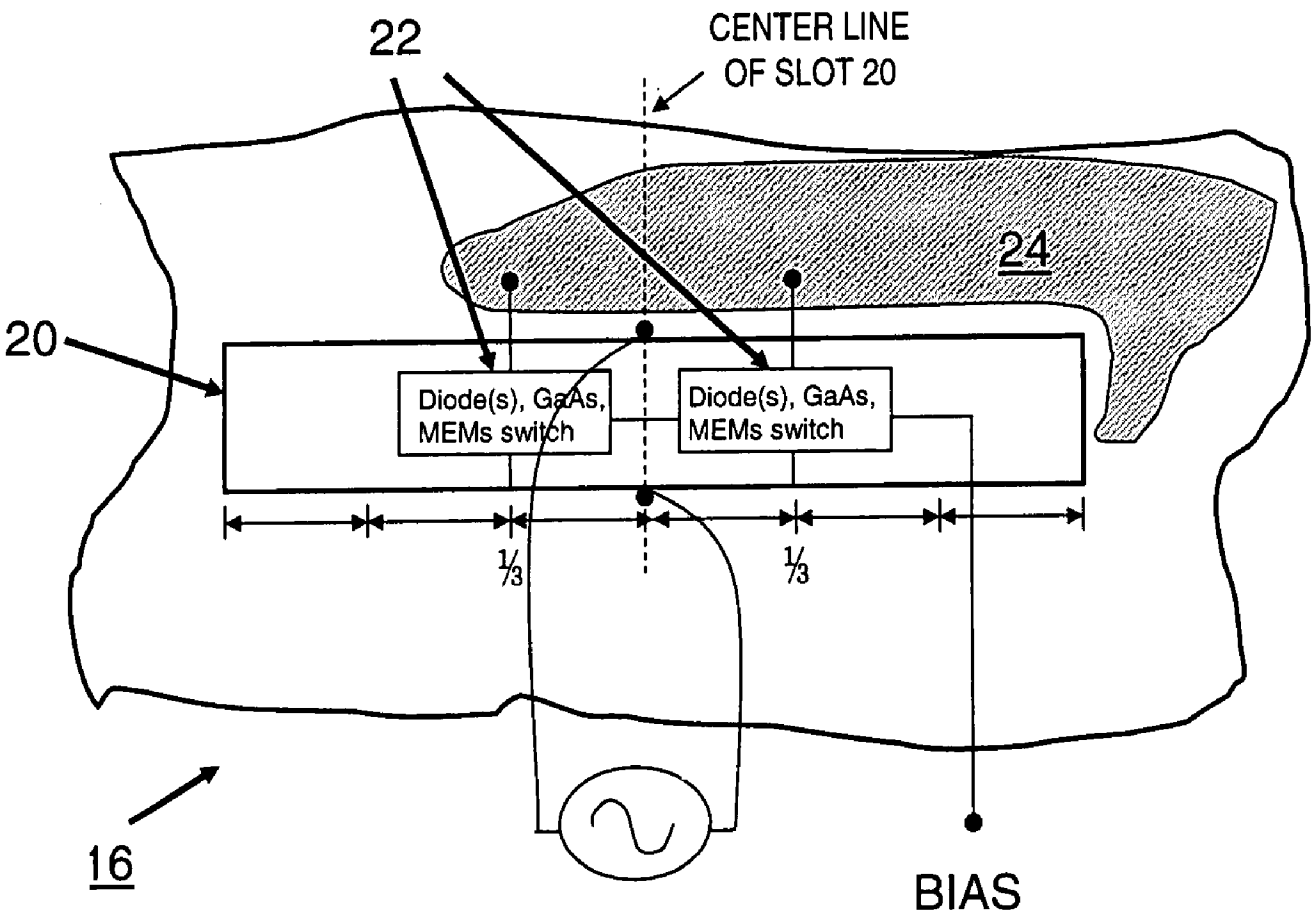
FIG. 6 illustrates GaAs (Gallium Arsenide) Field Effect Transistors (FETs) positioned across the slot of the slot antenna.

FIG. 6 illustrates electronic component 22 as a GaAs (Gallium Arsenide) Field Effect Transistor (FET). The current conduction terminals of the GaAs FET may span slot 20, with overlay layer 24 providing the isolation that allows the devices to properly act as switches. These low current devices may be incorporated into slot antenna 16 and allow communications device 10 to switch frequency bands electronically. Note that other devices such as, for example, RF Micro-Electro-Mechanical (MEM) devices may be used as switches for electronic components 22.

In operation, by controlling the conductivity of electronic components 22, the resonant frequency of slot 20 may be switched between separate frequencies while maintaining the basic radiation pattern shape. Although FIGS. 2–6 show two placements of electronic components 22, it should be understood that additional electronic components may be placed across slot 20 that allow slot antennas 16 to selectively operate at multiple resonant frequencies.

Figure 8:
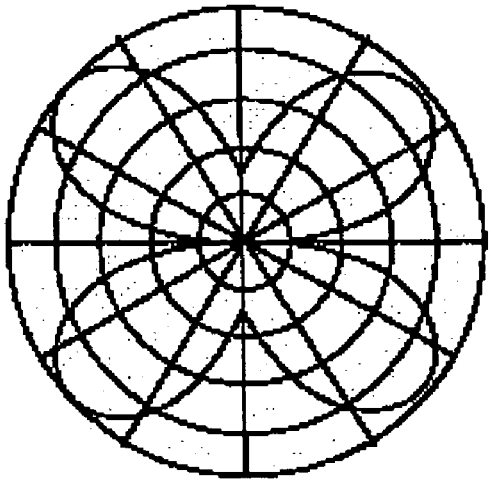
FIGS. 7–8 illustrate radiation patterns for the $\lambda/2$ mode and the $3\lambda/2$ mode generated by the slot antenna.
Figure 7:
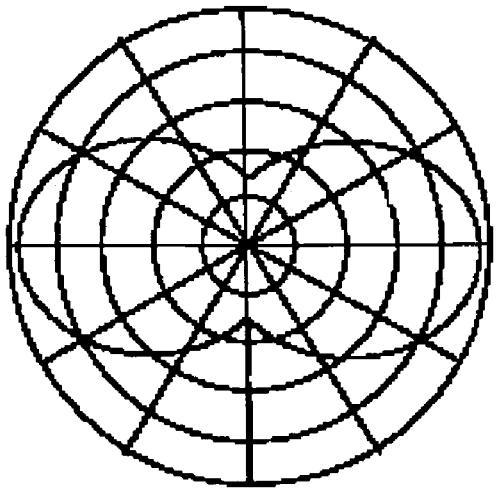

Another feature of the present invention allows two different modes of slot 20 to be excited at the same frequency. FIG. 6 illustrates placing electronic components 22 at one third the distance from the center feed point to the end of the slot, allowing a $3\lambda/2$ slot ($\lambda$ is the signal wavelength) to be excited in either of the two modes. In this example, one mode excites $\lambda/2$ and the other mode excites $3\lambda/2$. The radiation pattern generated by these two modes is different, as shown by the pattern for the $\lambda/2$ mode in FIG. 7 and the pattern for the $3\lambda/2$ mode in FIG. 8.

Wireless communications device 10 may include two or more antennas with overlapping propagation patterns to provide antenna diversity. That is, two or more antennas may receive the same signal or signals simultaneously and provide a number of advantages, such as noise cancellation, by combining signals from the two or more antennas or simply selecting the antenna that has better performance at any given time. Note that slot antenna 16 may provide a radiation pattern designed to transmit and/or receive a signal in a particular direction with respect to the antenna. In accordance with the present invention, slot antenna 16 generates coverage and provides directional gain when compared with an isotropic radiator. In other words, slot antenna 16 provides a steerable array pattern that may be advantageously used by wireless communications device 10.

Figure 9:
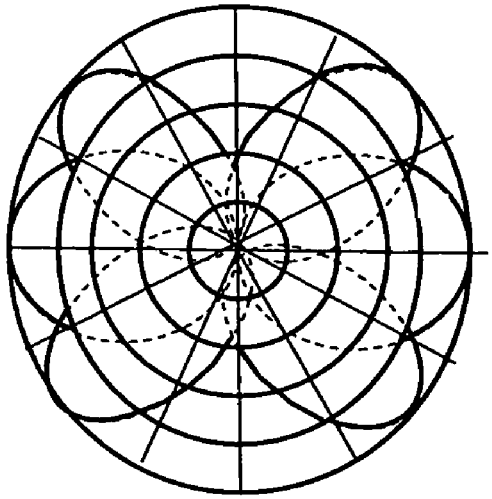
FIG. 9 shows the radiation pattern of the slot antenna biased to provide a pattern coverage that is effectively a "diversity composite" of the $\lambda/2$ mode and the $3\lambda/2$ mode.

Thus, the radiation pattern desired for wireless communications device 10 may be selected by the device itself, resulting in an improved pattern coverage by the receiving device. The desired radiation pattern and the preferred mode that wireless communications device 10 operates may be selected based on direction or signal conditions. As shown in FIG. 9, electronic components 22 may be biased to allow slot 20 to provide a pattern coverage that effectively covers the $\lambda/2$ mode and the $3\lambda/2$ mode. Depending on the signal direction, one mode of operation will perform better than the other. The resultant is an effective "composite" selection diversity pattern that may provide significant improvement in gain over that of a standard omni directional antenna. Note that pattern variations may be realized by changing the feed point of slot 20. The conductivity of the diodes (or other switch devices) may be switched from "off" to "on", and thereby, cause the symmetry of the slot to change and electrically reposition the feed point.

By now it should be apparent that the present invention for slot antennas 16 uses electronic components 22 located across slot 20 to enhance the ability of a wireless device to switch frequency bands electronically. The slot antennas, such as the ones described in FIGS. 2–6, may be incorporated to point in specific directions to provide a sector antenna array, yet the resonant frequency of the antenna may be shifted to provide dual band, or even multi-band frequency capabilities. The electronic components may further provide multiple radiation patterns.

While certain features of the invention have been illustrated and described herein, many modifications, substitutions, changes, and equivalents will now occur to those skilled in the art. It is, therefore, to be understood that the appended claims are intended to cover all such modifications and changes as fall within the true spirit of the invention.

What is claimed is:

1. A device comprising:

a conductive skin of the device having a slot to form an antenna; and first and second diodes positioned across the slot to operate the antenna at one of quasi-tunable frequency bands, wherein the first diode is connected to a first inductor and the second diode is connected to a second inductor to bias the first and second diodes.

2. The device of claim 1 wherein the first diode and the second diode are biased separately to provide two RF opens, two RF shorts or one RF open and one RF short.

3. The device of claim 1 wherein an anode of the first diode is commonly connected to the first inductor and a first capacitor and an anode of the second diode is commonly connected to the second inductor and a second capacitor.

4. The device of claim 1 wherein a cathode of the first diode and a cathode of the second diode are is connected to a first layer in which the slot is formed.

5. The device of claim 1 wherein the first diode is located at one third the distance from a center feed point to an end of the slot.

6. The device of claim 1 wherein the slot is excited in more than one mode, a first mode excites at a fundamental frequency of the slot and a second mode excites at a portion of the fundamental frequency by placing a short across the slot.

7. The device of claim 6 wherein a radiation pattern generated by the first mode is different that the second mode.

8. The device of claim 7 wherein the two different modes are excited at the same frequency and the radiation pattern is a combination of the radiation patterns of the two modes.

* * * * *